US006688501B2

(12) United States Patent
DeGroot et al.

(10) Patent No.: US 6,688,501 B2
(45) Date of Patent: Feb. 10, 2004

(54) DISPENSING CLOSURE FOR SPREADABLE PRODUCT

(75) Inventors: Susan DeGroot, Pewaukee, WI (US); Cori M. Blomdahl, Muskego, WI (US); David S. Pozgay, Milwaukee, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 10/115,188

(22) Filed: Apr. 2, 2002

(65) Prior Publication Data

US 2002/0104855 A1 Aug. 8, 2002

Related U.S. Application Data

(63) Continuation of application No. 09/591,576, filed on Jun. 9, 2000, now abandoned.

(51) Int. Cl.[7] ..... B65D 47/00
(52) U.S. Cl. ..... 222/556; 222/563; 222/575
(58) Field of Search ..... 222/212, 546, 222/556, 563, 575

(56) References Cited

U.S. PATENT DOCUMENTS

| | | | | |
|---|---|---|---|---|
| D136,098 | S | 8/1943 | Hartman | |
| 2,851,203 | A * | 9/1958 | Nowak | 222/543 |
| 4,735,334 | A * | 4/1988 | Abbott | 222/546 |
| 5,381,935 | A | 1/1995 | Moch | |
| 6,510,971 | B1 * | 1/2003 | Martin | 222/556 |

FOREIGN PATENT DOCUMENTS

| | | |
|---|---|---|
| CA | 976113 | 10/1975 |
| FR | 2790454 A1 | 9/2000 |
| GB | 2224309 A | 5/1990 |

OTHER PUBLICATIONS

Copy of prior patent application Ser. No. 09/591,576.
Copy of I.D.S. from prior application Ser. No. 09/591,576.
Copy of Form PTO–892 from prior application Ser. No. 09/591,576.
Advertizing sheets of Aquila.

* cited by examiner

*Primary Examiner*—Joseph A. Kaufman
(74) *Attorney, Agent, or Firm*—Wood, Phillips, Katz, Clark & Mortimer

(57) ABSTRACT

An improved dispensing closure system for dispensing a product from a container includes an elongate or oblong dispensing orifice for dispensing a ribbon of product. The dispensing closure system also includes a spout having a dispensing orifice that is oriented at an angle relative to the closure deck and relative to the flow direction of product from the orifice. The closure system provides for an abrupt "cut-off" of product and thus provides for the dispensing of product in a clean and controlled manner without mess. The closure system also incorporates conical geometries in transition surfaces extending from the container opening to the dispensing orifice. The conical geometries of the transition surfaces provides for a smooth transition of product flow from the container opening to the dispensing orifice, while minimizing the volume defined by the closure system spout and thereby providing increased "suck-back" and an abrupt "cut-off" of product compared to prior art devices.

2 Claims, 9 Drawing Sheets

FIG. 15
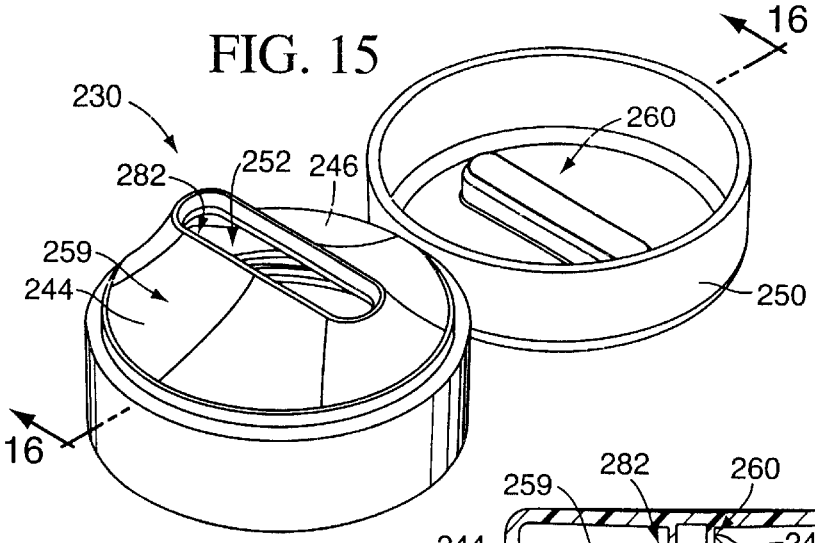
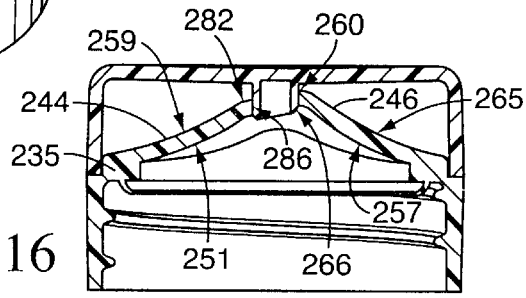
FIG. 16
FIG. 17
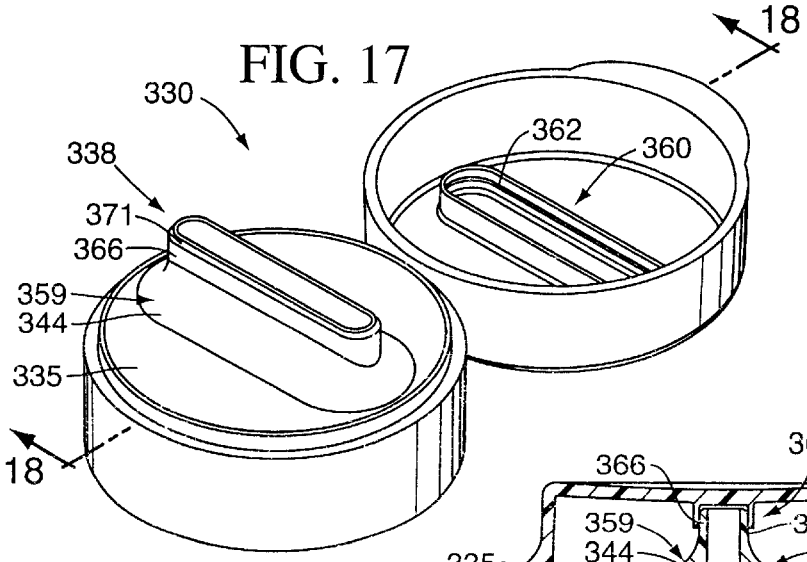
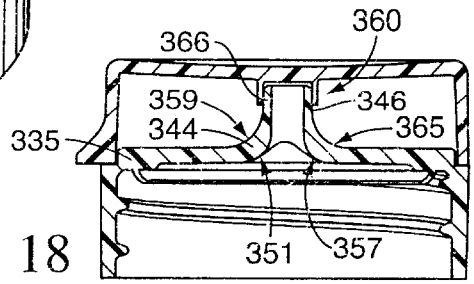
FIG. 18

FIG. 19
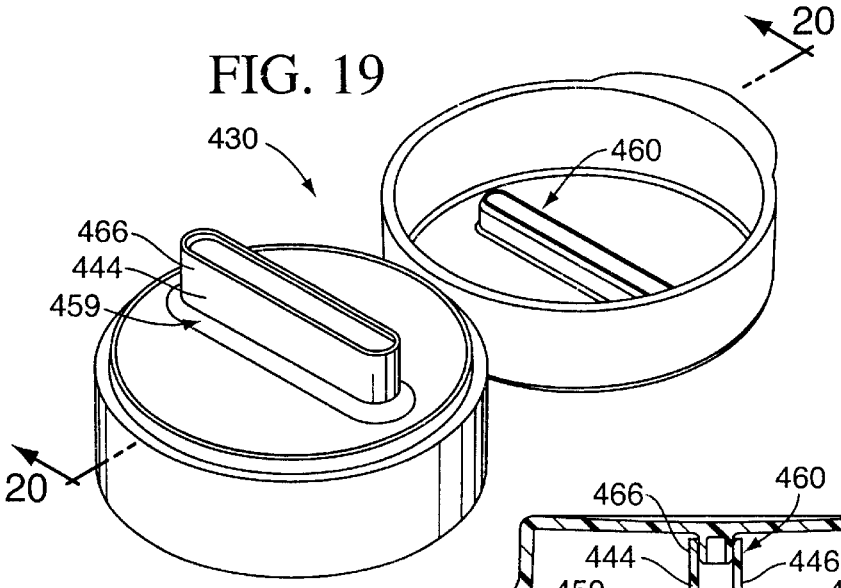
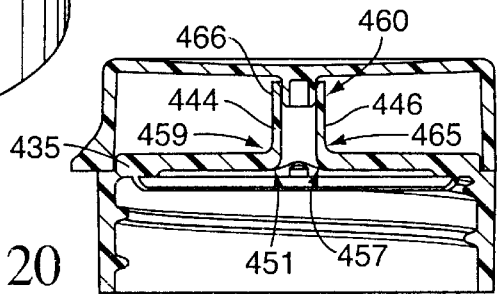
FIG. 20
FIG. 21
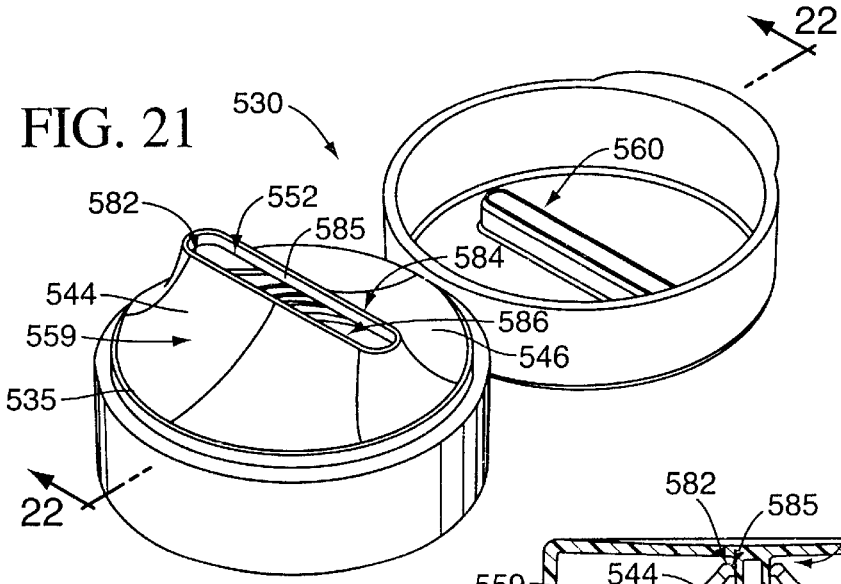
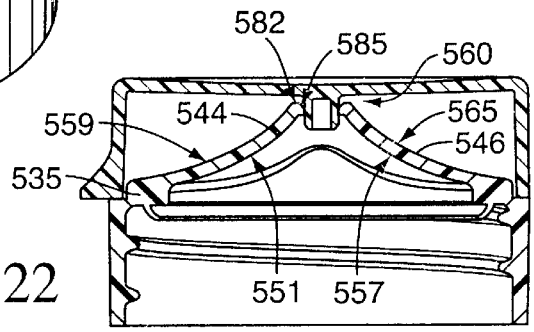
FIG. 22

FIG. 23
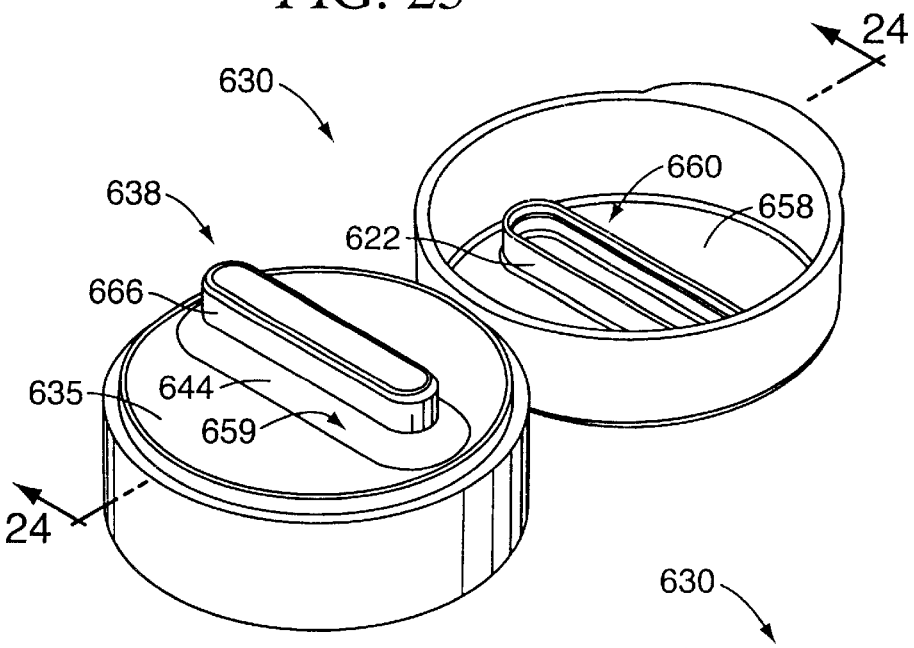
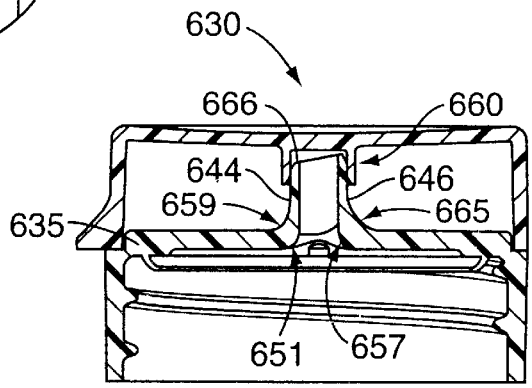
FIG. 24

DISPENSING CLOSURE FOR SPREADABLE PRODUCT

CROSS REFERENCE TO RELATED APPLICATION(S)

This is a continuation of U.S. patent application Ser. No. 09/591,576, filed Jun. 9, 2000 now abandoned.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The invention relates to resealable dispensing closure systems. More particularly, the invention relates to resealable dispensing closure systems for dispensing a ribbon of spreadable product, such as viscous food product, from a container, such as a squeeze bottle, in a clean, controlled manner.

BACKGROUND OF THE INVENTION AND TECHNICAL PROBLEMS POSED BY THE PRIOR ART

Dispensing closure systems for viscous food products, such as jellies, pastes, etc. are generally known. They typically include a closure body provided with a dispensing orifice of suitable dimension to permit passage of the food products.

Known dispensing closures for viscous food products are characterized by a number of disadvantages. For example, such closure systems do not provide for dispensing of a ribbon of product in a manner that maximizes the amount of product and that reduces the amount of user effort required to spread the product after dispensing. Another example of the disadvantages associated with known dispensing closure systems for viscous food products is that such dispensing closure systems typically lack the capability to make a clean "cut-off" of product immediately after dispensing has occurred. As such, use of such dispensing closures is often accompanied by spillage, product waste, and possibly unsanitary conditions as the product left on the closure system may be exposed to ambient conditions and become spoiled.

This problem stems in part from the geometrical limitations imposed on many dispensing closure systems. Typically, the transition from the container geometry, which is typically a round container opening, to the geometry of the dispensing orifice is characterized by abrupt transitions in the internal closure surfaces. The closure geometry is also related to the ability of the closure to provide a clean "cut-off" of product. Since product "cut-off" is a result of the vacuum created when a squeezable container is reformed to its original shape, it is desirable to minimize the volume within the closure system in order to maximize the amount of "suck-back" that occurs when the vacuum is created and thus maximize the retractive force applied to the extrudate of product to make a clean "cut-off." It would therefore be desirable to provide a dispensing closure system which provides favorable flow transitions from the container geometry to the dispensing orifice, yet which a enables sufficient "suck-back" to foster a clean "cut-off" for a variety of products of different viscosities and flow properties.

It would also be advantageous if such an improved closure system could accommodate bottles, containers, or packages which have a variety of shapes and that are constructed from a variety of materials. Further, it would be desirable if such an improved system could accommodate efficient, high-quality, large volume manufacturing techniques with a reduced product reject rate to produce a system with consistent operating characteristics.

BRIEF SUMMARY OF THE INVENTION

The present invention provides an improved dispensing closure system which addresses the aforementioned disadvantages in the prior art. Specifically, the present invention provides a system for dispensing a product from a container in a way that can be better controlled by the user. The system is especially suitable for dispensing viscous liquids, creams, pastes, jellies, etc. The user can easily ascertain the location where the product will be deposited and then deposit a ribbon-like extrudate of the product. The user can readily control the direction of product flow. Further, the starting and stopping of the product flow can be more precisely controlled. The product flow "cuts off" or terminates cleanly with little or no mess on the system exterior.

The dispensing closure system is adapted for use in dispensing a product from a container having an opening. The dispensing system may be formed as a unitary part of an end of such a container, or the system may be a separate assembly that is permanently or releasably attached to the container. The features of the containers on which the exemplary closure system may be used form no part of the invention described and claimed herein.

A primary aspect of the invention provides a dispensing closure system that includes an oblong dispensing orifice for dispensing a ribbon of product. Specifically, this aspect of the invention provides a dispensing closure system that includes a closure body having (1) a closure deck, (2) a skirt extending from the closure deck for engaging a container and (3) a spout extending from the closure deck, the spout including a dispensing orifice peripheral surface defining an oblong dispensing orifice.

Another primary aspect of the invention provides a dispensing closure system that includes a spout having a dispensing orifice that is oriented at an angle relative to the closure deck or relative to the flow direction of product from the orifice. In a preferred embodiment, this aspect of the invention provides a dispensing closure system that includes a closure body having (1) a closure deck, (2) a skirt extending from the closure deck for engaging a container and (3) a spout extending from the closure deck, the spout including (A) a dispensing orifice peripheral surface defining a dispensing orifice, (B) a rear wall extending to a rear spout end surface, and (C) a front wall extending to a front spout end surface, the rear wall extending further from the closure deck than the front wall. A dispensing closure system according to this aspect of the invention provides for an abrupt "cut-off" of product immediately after dispensing has occurred and thus provides for the dispensing of product in a clean and controlled manner without mess.

Another aspect of the invention provides a dispensing closure system which has improved flow and dispensing properties and which enhances the "suck-back" effect to provide a clean "cut-off" of product compared to prior art devices. This aspect of the invention derives from applicants' discovery, quite unexpectedly, that favorable flow properties and a clean "cut-off" are provided by the use of conical geometries in transition surfaces that extend at least part of the way from the container opening to the dispensing orifice. As used herein, the term "conical geometry" refers to surfaces which, entirely or in part, extend in a path that has the geometry of a conic section. That is, such surfaces, when viewed in cross section, have the profile of conic sections, including parabolic or hyperbolic geometry. In an exemplary embodiment, this aspect of the invention provides a dispensing closure system having (1) a closure deck, (2) a skirt extending from the closure deck for engaging a container and (3) a spout extending from the closure deck, the spout including (A) a dispensing orifice peripheral surface defining a dispensing orifice (B) a rear wall extending to a rear spout end surface, and (C) a front wall extending to a front spout end surface, at least one of the rear wall and front wall having a transition surface extending at least partially from the closure deck to the dispensing orifice peripheral surface, the transition surface having a conical geometry. A dispensing closure system according to this aspect of the invention provides for a smooth transition of product flow from the container opening to the dispensing orifice, while minimizing the volume defined by the closure system spout and thereby provides increased "suck-back," when used in conjunction with a flexible container creating a vacuum, and an abrupt "cut-off" of product compared to prior art devices.

Numerous other advantages and features of the present invention will become readily apparent from the following detailed description of the invention, from the claims, and from the accompanying drawings.

BRIEF DESCRIPTION OF THE DRAWINGS

The accompanying drawings form part of the specification, and like numerals are employed to designate like parts throughout the same.

FIG. 15 is a perspective view of another preferred embodiment of the present invention showing another preferred spout and orifice configuration;

FIG. 16 is a cross-sectional view taken along lines 16—16 of FIG. 15, but with the lid of the exemplary closure in a closed position;

FIG. 17 is a perspective view of another preferred embodiment of the present invention showing another preferred spout and orifice configuration;

FIG. 18 is a cross-sectional view taken along lines 18—18 of FIG. 17, but with the lid of the exemplary closure in a closed position;

FIG. 19 is a perspective view of another preferred embodiment of the present invention showing another preferred spout and orifice configuration;

FIG. 20 is a cross-sectional view taken along lines 20—20 of FIG. 19, but with the lid of the exemplary closure in a closed position;

FIG. 21 is a perspective view of another preferred embodiment of the present invention showing another preferred spout and orifice configuration;

FIG. 22 is a cross-sectional view taken along lines 22—22 of FIG. 21, but with the lid of the exemplary closure in a closed position;

FIG. 23 is a perspective view of another preferred embodiment of the present invention showing another preferred spout and orifice configuration; and FIG. 24 is a cross-sectional view taken along lines 24—24 of FIG. 23, but with the lid of the exemplary closure in a closed position.

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, most of the figures illustrating the invention show a dispensing system in the typical orientation that it would have at the top of a container when the container is stored upright on its base, and terms such as upper, lower, horizontal, etc., are used with reference to this position. It will be understood, however, that the dispensing system of this invention may be manufactured, stored, transported, used, and sold in an orientation other than the position described.

The dispensing system of this invention is suitable for use with a variety of conventional or special containers having various designs, the details of which, although not illustrated or described, would be apparent to those having skill in the art and an understanding of such containers. The container per se described herein forms no part of and therefore is not intended to limit the present invention. It will also be understood by those of ordinary skill that novel and non-obvious inventive aspects are embodied in the described exemplary closure systems alone.

Figure 1:
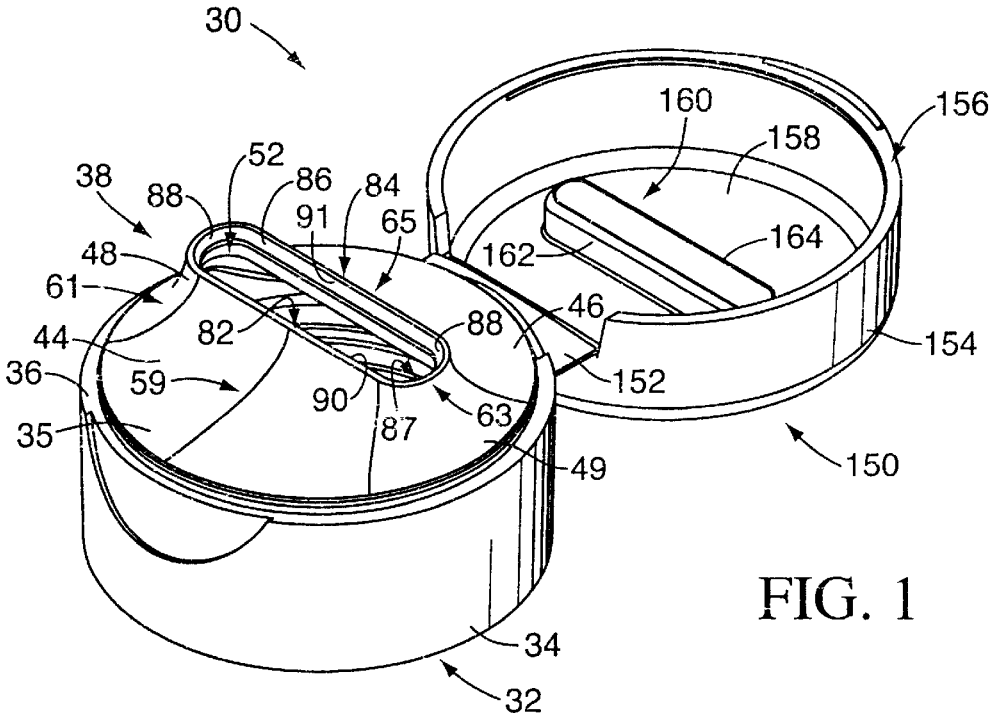
FIG. 1 is a perspective view of an exemplary dispensing closure system in the form of a separate dispensing closure according to a preferred embodiment of the invention shown in an open position and from a vantage point generally above or from the top of the exemplary closure system.

An exemplary embodiment of a dispensing closure system 30 according to the invention is illustrated in FIGS. 1–14. The dispensing closure system 30 is adapted to engage a container (not illustrated). As can be seen in FIG. 1, the closure system 30 has a closure body 32 which includes a hollow, generally cylindrical base or skirt 34, and annular shoulder 36 extending radially inwardly from the top of the skirt 34. The dispensing closure system also includes a spout 38 extending upwardly from the inner portion of the shoulder 36. As can best be seen in FIG. 2, the interior of the skirt 34 defines an internal, female thread 40. The skirt 34 is adapted to receive and threadingly engage the upper end of a container mouth (not illustrated). The skirt thread 40 is adapted to matingly engage a thread on the container mouth or neck. A lower edge of the closure skirt 34 includes a number of slots or recesses 37 which are utilized by automated machinery to turn the closure body 32 and thereby unscrew the closure body 32 to remove it from an injection mold.

Alternatively, the closure skirt 34 could be provided with some other container connecting means, such as a snap-fit bead or groove (not illustrated) in place of the thread 40 for engaging a container groove or bead (not illustrated), respectively, in the container neck. The closure body 32 could also be permanently attached to the container by means of induction melting, ultrasonic melting, gluing, or the like, depending on materials used for the closure body 32 and in the container. The closure body 32 could also be formed as a unitary part, or extension, of the container.

The closure body skirt 34 may have any suitable configuration. The container could have an upwardly projecting neck or other portion for being received within the particular configuration of the closure body 32, and the main part of the container may have a different cross-sectional shape than the container neck and closure body skirt 34.

The closure system 30 is adapted to be used with a container having a mouth or other opening to provide access to the container interior and to a product contained therein. The product may be, for example, a comestible product such as a food paste, jelly or jam. The closure 30 is especially suitable for dispensing the viscous product in a ribbon-like extrudate. However, the closure 30 could also be used with many other materials, including, but not limited to, relatively low viscosity liquids, particulates, etc. as constituting a food product, a personal care product, an industrial or household cleaning product, or other chemical compositions (e.g., compositions for use in activities involving manufacturing, commercial or household maintenance, construction, agriculture, etc.).

The container with which the closure system may be used would typically be a squeezable container having a flexible wall or walls which can be grasped by the user and squeezed or compressed to increase the internal pressure within the container so as to force the product out of the container and through the closure 30. The container wall typically has sufficient, inherent resiliency so that when the squeezing forces are removed, the container wall returns to its normal, unstressed shape. Such a squeezable wall container is preferred in many applications but may not be necessary for preferred in other applications. For example, in some applications it may be desirable to employ a generally rigid container and pressurize the container interior at selected times with a piston or other pressurizing system.

Figure 2:
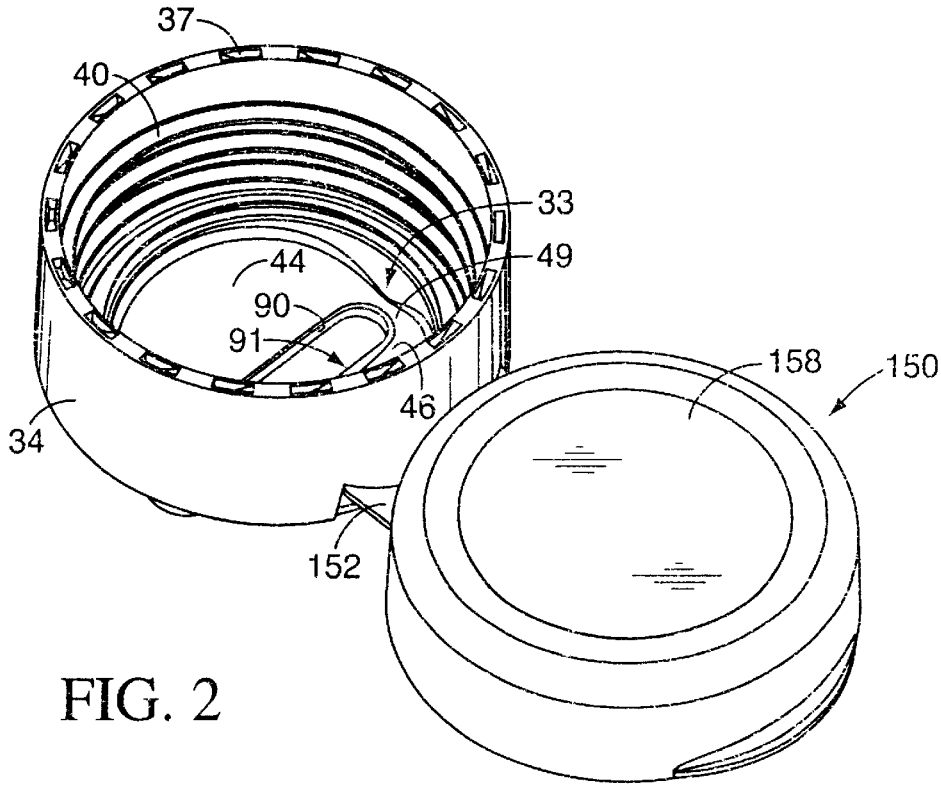
FIG. 2 is a perspective view of the exemplary dispensing closure of FIG. 1, illustrated from a vantage point generally beneath or from the underside of the closure system.

Still referring to FIGS. 1 and 2, a lid 150 is preferably hingedly connected to the closure body 32 with a snap action hinge 152. Such a hinge is disclosed in the U.S. Pat. No. 5,642,824, the disclosure of which is incorporated herein by reference thereto. In an alternate embodiment, the lid 150 need not be connected with a snap-action hinge. A floppy hinge may be used instead. Further, in another embodiment (not illustrated), the hinge 152 may be omitted entirely, and the lid 150 can be completely separate, and completely removable, from the closure body. In some applications, the lid 150 be omitted altogether.

In the exemplary closure system 30, the lid 150 includes a sidewall or skirt 154 from which the hinge 152 extends to the body 32. The lid skirt 154 has a lid seating surface 156. When the lid 150 is closed, the lid seating surface 156 engages the annular shoulder 36 defined on the closure body 32 at the top of the closure body skirt 34.

Referring additionally to FIGS. 3, 11, 12, 14 and 14A, in accordance with a primary feature of the invention, the exemplary closure system 30 includes an oblong or elongated dispensing orifice 52 formed in the spout 38 for permitting dispensing of a product in a ribbon like extrudate. The dispensing orifice 52 is defined by a dispensing orifice peripheral surface 86. As shown in FIGS. 1 and 2, the dispensing orifice peripheral surface 86 includes a front portion 90 and a back portion 91 which is substantially parallel to the front portion 90. The dispensing orifice peripheral surface 86 also includes a pair of rounded lateral portions 88 (FIG. 1). This unique shape of the dispensing orifice 52 permits a user to dispense a ribbon of product in a controlled manner and reduces or eliminates effort required to spread the product after it is dispensed from the container.

Figure 5:
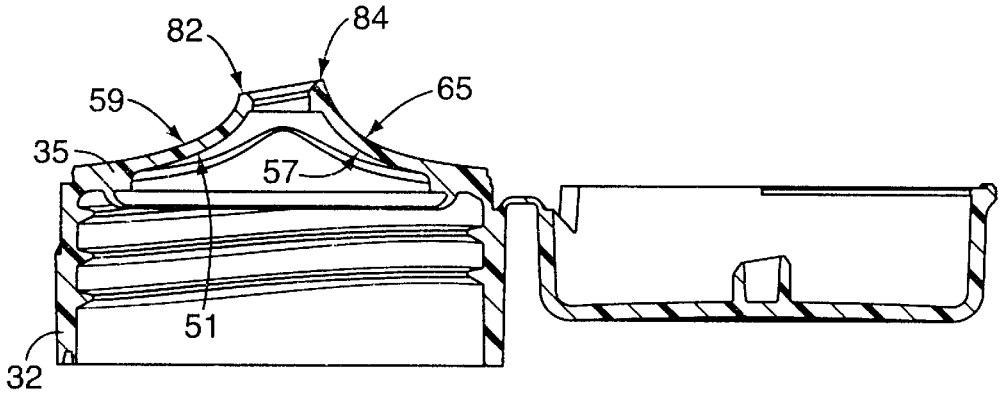
FIG. 5 is a cross-sectional view taken along lines 5—5 of FIG. 3.
Figure 6:
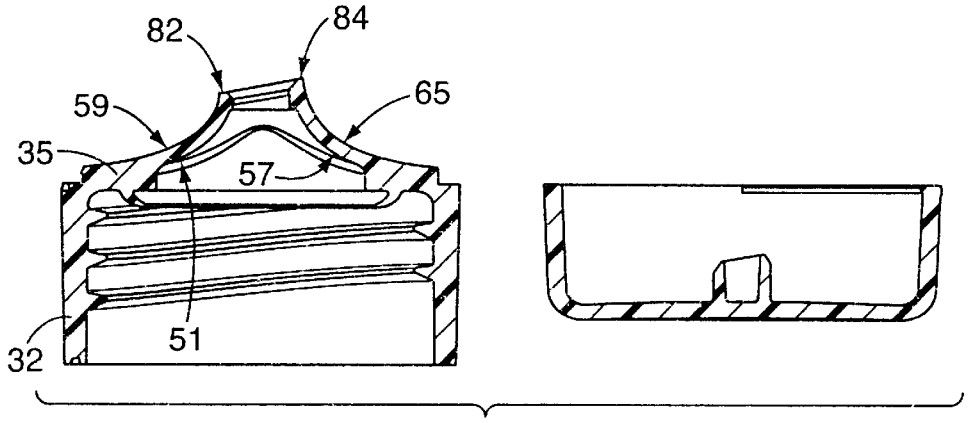
FIG. 6 is a cross-sectional view taken along lines 6—6 of FIG. 3.
Figure 7:
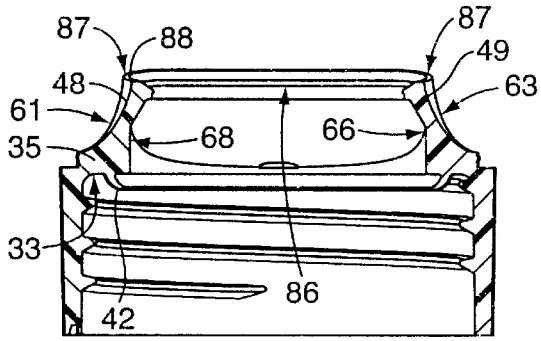
FIG. 7 is a cross-sectional view taken along lines 7—7 of FIG. 3.

As best illustrated in FIGS. 1–10 and 12, the outer periphery of the spout 38 includes a closure deck 35 (FIGS. 4–6) having a seating surface 33 formed thereon. The spout 38 is formed by four spout walls or portions that extend upward from the closure deck 35. A front spout wall 44 extends upward from the closure deck 35 to a spout front wall end surface 82 (FIGS. 4–6 and 14A). A rear spout wall 46 extends from the closure deck 35 upward to a spout rear wall end surface 84 (FIGS. 4–6 and 14A). The front spout wall 44 and rear spout wall 46 are on opposite sides of the closure body 32. The spout 38 also includes a pair of lateral or side walls that extend upward from the closure deck 35 to lateral end surfaces. A right spout wall 49 extends upward from the closure deck 35 to a lateral end surface 87, and a left spout wall 48 extends upward from the closure deck 35 to a lateral end surface 87 (FIG. 7). In the illustrated embodiment, the spout front wall end surface 82, the spout rear of wall end surface 84 and the lateral end surfaces 87 form a continuous surface. It will be understood, however, that the invention contemplates other end surface configurations and that the end surfaces 82, 84 and 87 need not form a continuous single surface but may be discrete surfaces at different elevations or angles with respect to one another.

Figure 10:
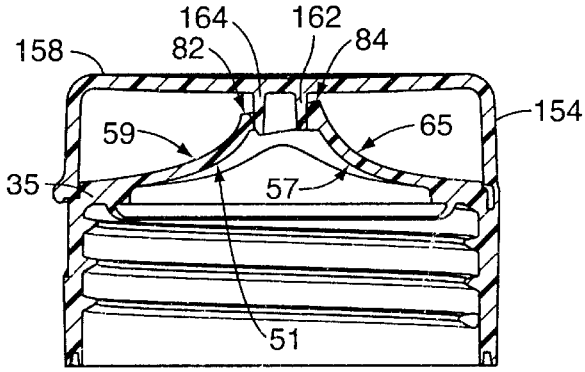
FIG. 10 is a cross-sectional view taken along lines 4—4 of FIG. 3, but with lid of the exemplary closure in a closed position.
Figure 12:
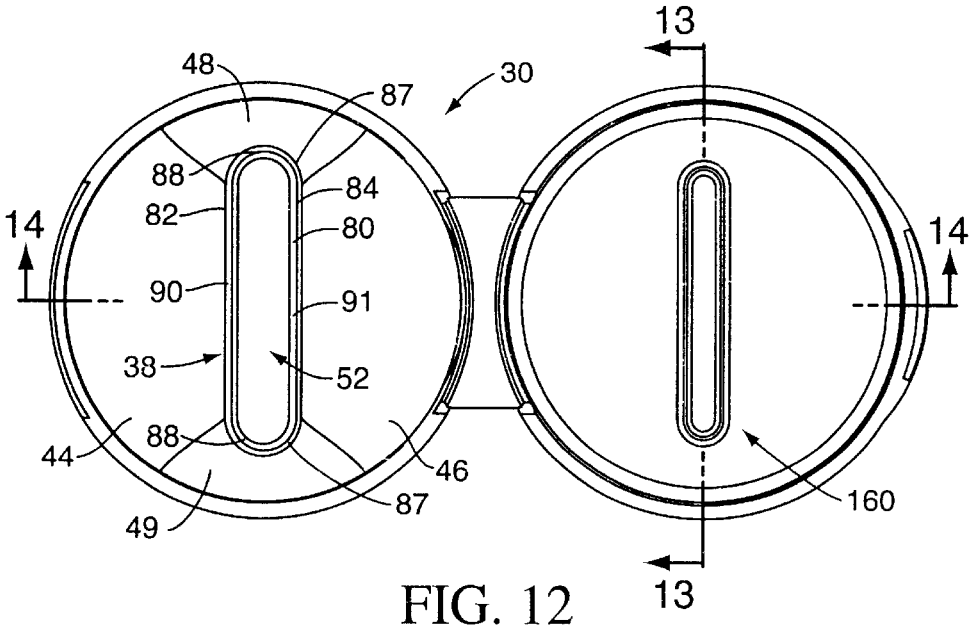
FIG. 12 is an enlarged, top view of the exemplary closure of FIG. 1.
Figure 11:
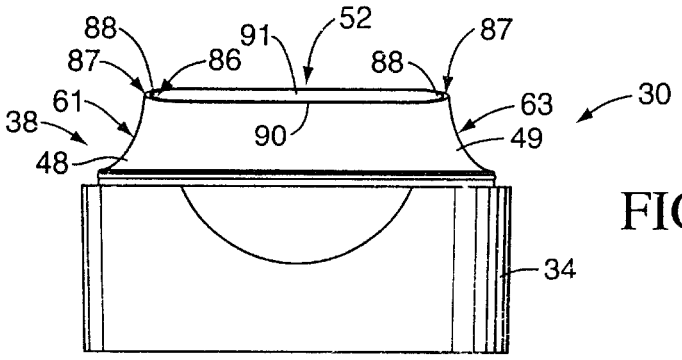
FIG. 11 is a side elevational view of the exemplary closure body of FIG. 1.

The lid 150 includes an orifice sealing member or "spud" 160 which extends from a lid end wall 158 and which is adapted to sealingly engage the dispensing orifice peripheral surface 86 when the lid 150 is pivoted from the open position (illustrated in FIG. 1) to a closed position (illustrated in FIG. 10). The orifice sealing member 160 includes an orifice sealing member back portion 162 and the orifice sealing member front portion 164. The terms "front" and "back" as used here reflect the position of the orifice sealing member 160 when the lid 150 is in the closed position. As will be recognized, the orifice sealing member 160 is of a complementary shape relative to the shape of the dispensing orifice 52.

Figure 13:
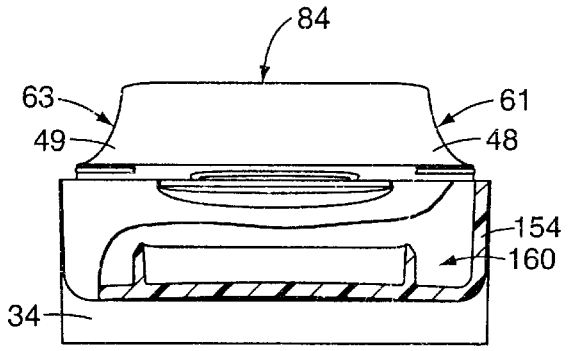
FIG. 13 is a partial cross-sectional view taken along lines 13—13 of FIG. 12.
Figure 14A:
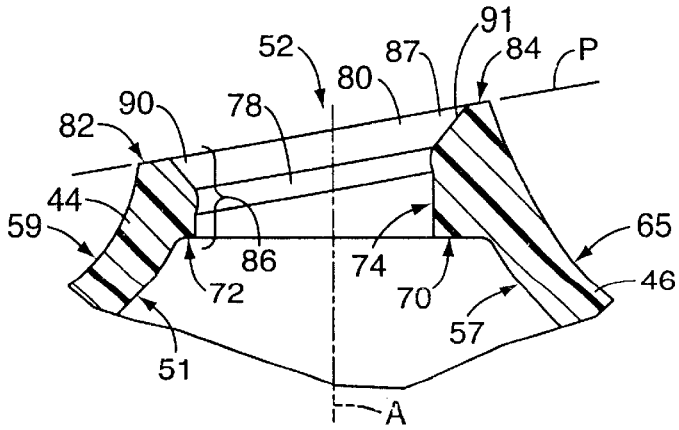
FIG. 14A is an enlarged, fragmentary portion of FIG. 14.
Figure 14B:
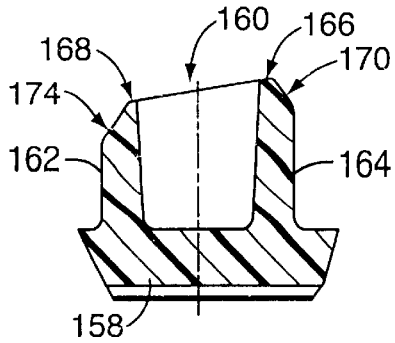
FIG. 14B is an enlarged, fragmentary portion of FIG. 14.
Figure 14:
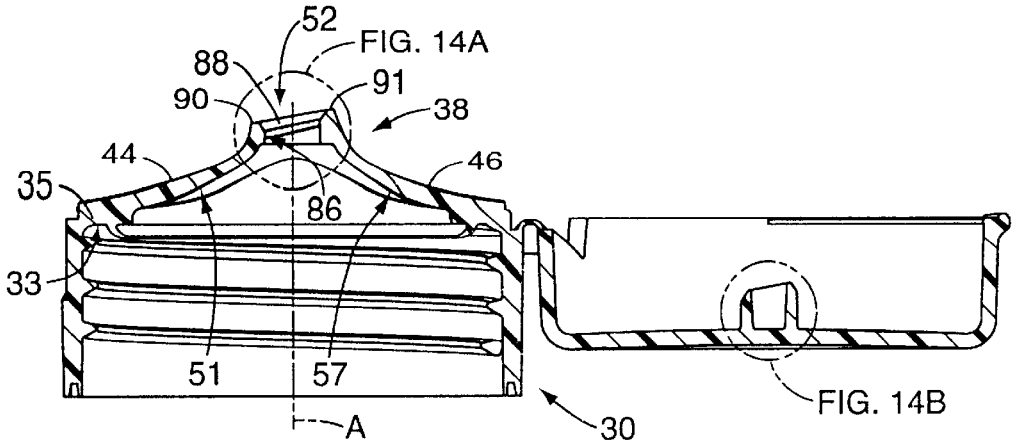
FIG. 14 is a cross-sectional view taken along lines 14—14 of FIG. 13.

Referring specifically to FIGS. 13, 14 and 14A, the dispensing orifice 52 is defined by the dispensing orifice peripheral surface 86, which, in the exemplary embodiment, includes a spout upwardly extending surface 74, a spout interior sealing bead 78 and a spout outwardly tapered surface 80. As seen in FIG. 14A, the dispensing orifice peripheral surface 86 extends upward from a front spout interior shoulder 72 and from a rear spout interior shoulder 70.

Referring specifically to FIG. 14B, the orifice sealing member 160 includes a tapered surface 170, 174 around its periphery. Specifically, the orifice sealing member back portion 162 includes orifice sealing member back portion intermediate surface 174 and the orifice sealing member front portion 164 includes a orifice sealing member front portion intermediate surface 170. As will be recognized, the intermediate surfaces 170 and 174 together with intermediate surfaces on the side portions of the orifice sealing member 160 form a continuous surface that extends around the periphery of the orifice sealing member 160. Owing to the taper of the intermediate surfaces, the orifice sealing member 160 is permitted to sealingly engage the dispensing orifice peripheral surface 86 without undue interference as the lid 150 is pivoted to its closed position. End surfaces 166, 168 define an orifice sealing member plane which forms an acute angle with the central axis or plane of the orifice sealing member 160. As can be seen from a cross-section illustrated in FIG. 14B, the orifice sealing member front portion 164 and the orifice sealing member back portion 162 may extend from the lid end wall 158 at an angle that is slightly greater than 90 degrees and thus outward from one another. This provides a resilient bias with regard to the orifice sealing member 160 which is useful to enhance the sealing engagement with the dispensing orifice peripheral surface 86. The sealing bead 78 on the interior of the closure body spout 38 improves sealing engagement with the external surface of the orifice sealing member 160.

Referring to FIGS. 14 and 14A, in accordance with another primary feature of the invention, the front spout wall end surface 82 and the back spout wall end surface 84 define and orifice plane (P) which extends at an acute angle relative to an axis (A) of the closure body 32 or which is not parallel to a plane defined by the closure body seating surface 33. The axis (A) is preferably defined by the flow direction of the product through the orifice 52. Owing to the upwardly extending surfaces 74 (FIG. 14) of the dispensing orifice peripheral surface 86, the product being dispensed tends to flow parallel to those surfaces through the dispensing orifice 52. Owing to the angled orifice, the spout rear wall 46 extends from the closure deck 35 to a higher elevation then does the spout front wall 44. The spout lateral wall end surfaces 87 join the spout front wall end surface 82 and the spout rear wall end surface 84 to form a continuous surface within the orifice plane (P). This aspect of the invention provides enhanced "cut-off" of the product and therefore reduces the possibility of spillage or product waste.

Figure 4:
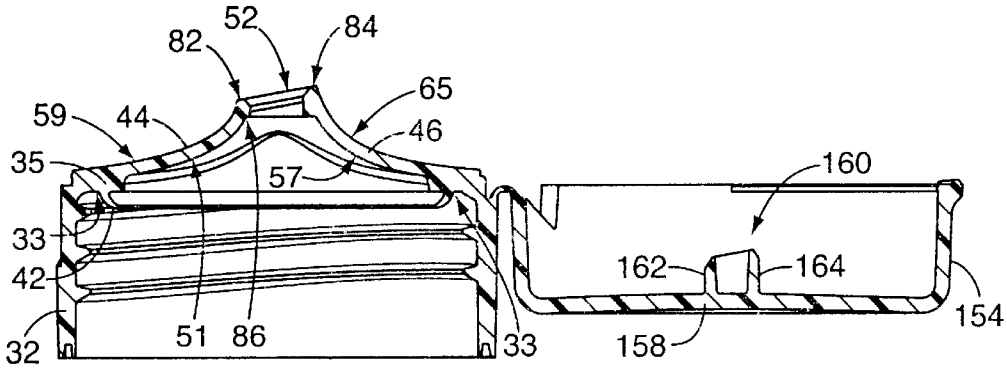
FIG. 4 is a cross-sectional view taken along lines 4—4 of FIG. 3.

In accordance with another primary feature of the invention, conical transition surface geometries are utilized on the closure body 32 in order to improve the transition of product flow from the container opening to the dispensing orifice 52 and to improve product "cut-off" by reducing the volume beneath the spout 38. FIGS. 4, 5 and 6 are respective cross-sections taking along lines 4—4, 5—5 and 6—6 in FIG. 3, which is a top view of an exemplary closure system according to the invention. As can be seen in FIGS. 4–6, an annular "crabs claw" seal 42 projects downwardly from the closure body seating surface 33 and is adapted to sealingly engage the upper, annular edge of the container (not illustrated) on which the closure 30 is mounted. In accordance with the invention, the spout front wall 44 includes a spout front wall interior transition surface 51 which, in this exemplary embodiment, at least partially follows a parabolic path from the closure deck 35 to the dispensing orifice peripheral surface 86. Similarly, the spout rear wall 46 includes a spout rear wall interior transition surface 57 which, in this exemplary embodiment, at least partially follows a parabolic path from the closure deck 35 to the dispensing orifice peripheral surface 86. As can also be seen from FIGS. 4–6, the spout front wall 44 also includes an exterior surface 59 which follows a parabolic path from the closure deck 35 to the spout front wall end surface 82. Similarly, to provide substantially uniform spout wall thicknesses, the spout rear wall 46 includes an exterior surface 65 which follows a parabolic path from the closure deck 35 to the spout rear wall end surface 84. It will be understood by those of ordinary skill in the art that the exterior surfaces of the spout front wall 44 and the spout rear wall 46 do not necessarily have to be of a conical geometry but may be of other geometries as needed for particular aesthetic and/or functional requirements of the particular closure system.

Figure 3:
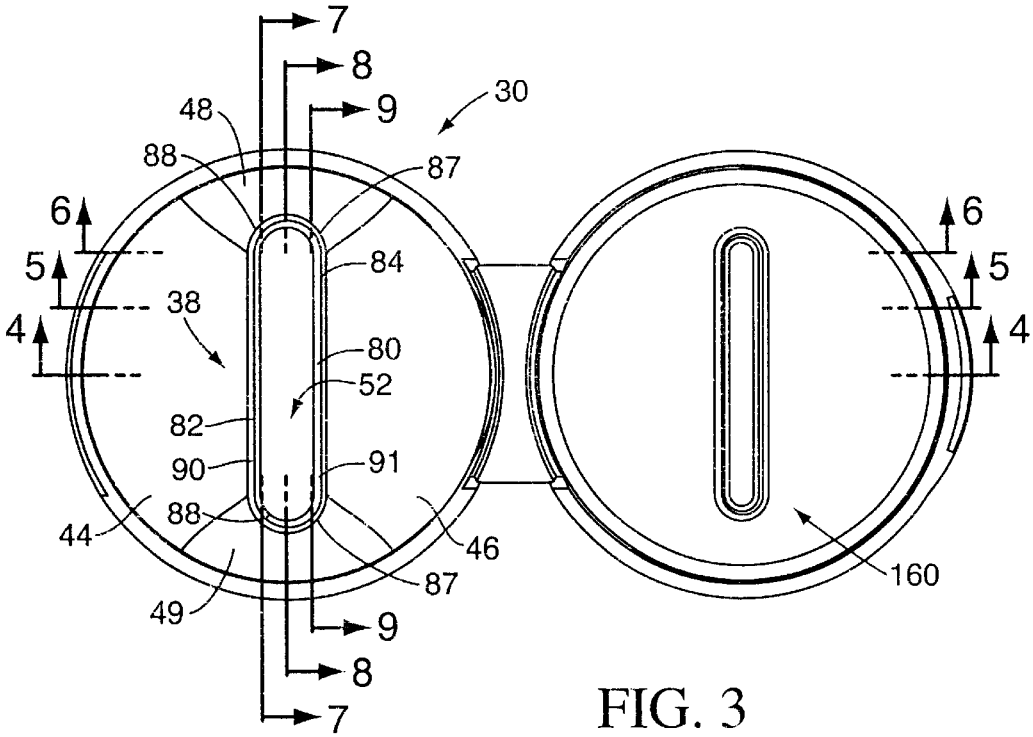
FIG. 3 is a top view of the exemplary dispensing closure of FIG. 1.
Figure 8:
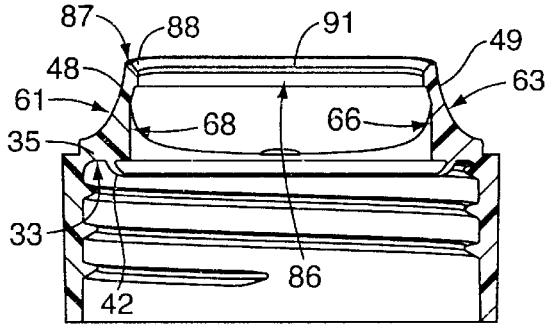
FIG. 8 is a cross-sectional view taken along lines 8—8 of FIG. 3.
Figure 9:
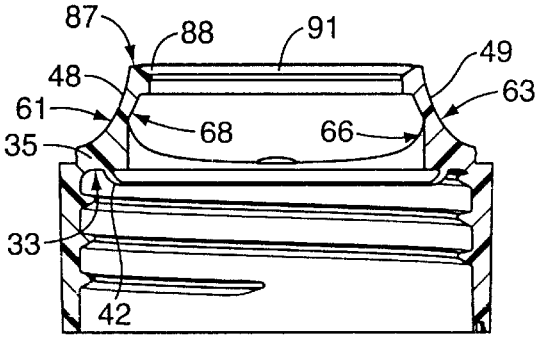
FIG. 9 is a cross-sectional view taken along lines 9—9 of FIG. 3.

FIGS. 7–9 are cross-sections taken along lines 7—7, 8—8 and 9—9 in FIG. 3, respectively. In this exemplary embodiment, the internal transition surfaces of the lateral portions of the spout 38 do not include conical geometries. Rather, the spout left wall 48 and spout right wall 49 include interior surfaces which extend in a generally vertical direction and which may include a tapered portion which extends inward to the dispensing orifice peripheral surface 86. It will be understood however by those of ordinary skill in the art that conical geometries may be employed on the internal surfaces of the spout left and right walls without departing from the spirit and scope of the invention. The spout left wall 48 includes an interior surface 68 which includes a generally vertical surface and an inwardly tapered surface extending towards the dispensing orifice peripheral surface 86. The spout left wall 48 also includes an exterior surface 61 which extends according to a conical geometry from the closure deck 35 to the end surface 87 of the spout left wall. Similarly, the spout right wall 49 includes an interior surface 66 which has a generally vertical surface and an inwardly tapered surface. The spout right wall 49 also includes an exterior surface 63 which extends from the closure deck 35 to the right wall end surface 87 according to a conical geometry.

FIGS. 15 and 16 illustrate another exemplary closure system 230 according to the invention. In this embodiment, the spout front wall 244 extends at a more gradual slope from the closure deck 235 to the front wall end surface 282 according to a conical geometry, but at a more gradual slope than in the embodiment illustrated in FIGS. 1–14. Moreover, the front wall end surface 282 forms a much larger angle with the spout front wall exterior surface 259 compared to the corresponding surfaces in the embodiment illustrated in FIGS. 1–14. This provides a smoother finish which is easier to clean. The spout front wall 244 includes an internal transition surface 251 which extends from the closure deck 235 at least partially to the dispensing orifice peripheral surface 286 according to a conical geometry, preferably a parabola. Similarly, the spout rear wall 246 includes any internal transition surface 257 that extends according to a conical geometry which is steeper and therefore different from the conical geometry of the spout front wall internal transition surface 251. As can be seen in FIG. 16, the orifice sealing member 260 is provided with an angled end surface 266 which accommodates entry of the orifice sealing member 260 into the angled dispensing orifice 252 when the lid 250 closes.

FIGS. 17 and 18 illustrate another exemplary closure system 330 according to the invention. In this embodiment, the spout walls are formed with a substantially vertical portion and a more abrupt transition from the closure deck 335. The spout front wall 344 includes an internal transition surface 351 which is of a substantially constant radius extending from the closure deck 335 to a vertical portion 366 of the front spout wall 344. Similarly, the rear spout wall 346 includes an internal transition surface 357 which is of a substantially constant radius extending from the closure deck 335 to the vertical portion 366. External transition surfaces 359 and 365 are formed as curved surfaces of a substantially constant radius. In contrast to the previously described embodiments, the orifice sealing member 360 in this embodiment is adapted to engage an outer surface of the spout 338. To that end, the spout 338 is provided with a tapered outer surface 371 (FIG. 17) extending around its periphery. Similarly, the orifice sealing member 360 is provided with an inner tapered surface 362. Also in contrast to the previously described embodiments, the orifice is not angled relative to the closure deck 335.

FIGS. 19 and 20 illustrate yet another exemplary closure system 430 according to the invention. In this embodiment, the vertical portion 466 of the spout wall is larger compared to the embodiment described relative to FIGS. 17 and 18. The internal transition surface 451 of the spout front wall 444 follows a path of a substantially constant radius from the closure deck 435 to the vertical portion 466. Similarly, the internal transition surface 457 of the spout rear wall 446 follows a path of a substantially constant radius from the closure deck 435 to the vertical portion 466. External transition surfaces 459 and 465 are also provided with constant radii. As is apparent from the figures, the radii of these transition surfaces, both internal and external, are smaller than the radii of the transition surfaces of the embodiment shown in FIGS. 17 and 18, thereby reducing the material cost to manufacture the exemplary closure system 430. In this embodiment, the orifice sealing member 460 is adapted to engage in the interior surface of the spout 438.

FIGS. 21 and 22 illustrate yet another exemplary closure system 530 according to the invention. In this embodiment, the dispensing orifice 552 is angled differently compared to the embodiment illustrated in FIGS. 1–14. That is, the front spout wall 544 extends to substantially the same elevation from the closure deck 535 as the elevation of the rear spout wall 546. Both the front spout wall 544 and the rear spout wall 546 include internal transition surfaces. The front spout wall internal transition surface 551 extends according to a conical geometry from the closure deck 535 to the dispensing orifice peripheral surface 586. The rear spout wall internal transition surface 557 extends according to a conical geometry from the closure deck 535 to the dispensing orifice peripheral surface 586. External transition surfaces 559 and 565 are also provided on the front spout wall 544 and rear spout wall 546, respectively. As can be seen by the detail in FIG. 22, the dispensing orifice peripheral surface 586 includes an inwardly tapered surface 585 which extends inward from the front spout wall end surface 582 and the rear spout wall end surface 584 to form an interference fit with the orifice sealing member 560 when the lid is in the closed position shown in FIG. 22.

FIGS. 23 and 24 illustrate yet another exemplary closure system 630 according to the invention. In this embodiment, the closure is provided with internal transition surfaces of a substantially constant radius and a spout wall with a substantially vertical portion 666 and an angled orifice plane. The orifice sealing member 660 is adapted to engage an outer surface of the spout 638 and does not include a tapered end. That is, the peripheral wall 662 of the orifice sealing member 660 extends to substantially the same elevation relative to the lid end wall 658 around the entire periphery of the orifice sealing member 660. The front spout wall 644 includes an internal transition surface 651 which extends from the closure deck 635 to the vertical portion 666 along a path of a substantially constant radius. Similarly, the rear spout wall 646 includes an internal transition surface 657 which extends from the closure deck 635 to the vertical portion along a path of substantially constant radius. External transition surfaces 659 and 665 are provided to transition from the closure deck thickness to the vertical portion thickness.

It will be readily apparent from the foregoing detailed description of the invention and from the illustrations thereof that numerous variations and modifications may be effected without departing from the true spirit and scope of the novel concepts or principles of this invention. For example, although the closure assembly of the invention is exemplified by a threaded engagement with the container, the invention contemplates other fastening techniques and implements for securing the closure assembly to the container. For example, since the invention provides a closure assembly that obviates the need for relatively large sealing forces to be applied via threads on the closure assembly and container finish, threadless fastening of the closure assembly relative to the container is contemplated by the invention. Such fastening might incorporate a friction fit facilitated by a closure assembly having a skirt with an inside diameter sized to provide a sliding or telescoping engagement with a smooth, threadless container finish. In such an embodiment, the fitment and closure body would be provided with abutment surfaces, for example, a bayonet type interlock or fastening implement, which permit installation of the closure assembly on the container, but which may be configured, for example, by relative rotation of the closure body and container, to restrict upward movement of the closure body relative to the container.

What is claimed is:

1. A dispensing closure system for dispensing a ribbon of product from a container, the closure system comprising:

a body having a deck and a skirt extending from the deck for engaging the container, said deck extending substantially in a plane, said body having a recessed annular shoulder around the deck;

a spout extending from the deck and including a dispensing orifice peripheral surface defining an oblong dispensing orifice, the spout including a long back spout wall and a long front spout wall with said back and front spout walls extending substantially parallel to one another and substantially perpendicular to the plane of the deck; and a closure lid secured to the closure body for selective pivoting about an axis substantially parallel to said deck plane and substantially parallel to said back and front spout walls, said closure lid having an orifice sealing member engageable about said back and front spout walls with said sealing member comprising an oblong wall which is substantially orthogonal to the plane of the deck when engaged with the front and back spout walls when the lid is closed, said lid having a lid skirt receivable on said shoulder when the closure lid is closed, said shoulder cooperating with said lid skirt to position said closure lid and orifice sealing member relative to said body and said spout when said lid is closed.

2. The dispensing closure system of claim 1, further comprising a curved wall connecting said deck to said back and front spout walls, wherein said sealing member oblong wall overlaps said back and front spout walls when said lid is closed.

* * * * *

US006688501C1

(12) INTER PARTES REEXAMINATION CERTIFICATE (0066th)

United States Patent

DeGroot et al.

(10) Number: US 6,688,501 C1

(45) Certificate Issued: May 12, 2009

(54) DISPENSING CLOSURE FOR SPREADABLE PRODUCT

(75) Inventors: Susan DeGroot, Pewaukee, WI (US); Cori M. Blomdahl, Muskego, WI (US); David S. Pozgay, Milwaukee, WI (US)

(73) Assignee: Seaquist Closures L.L.C., Mukwonago, WI (US)

Reexamination Request:
No. 95/001,074, Oct. 9, 2008

Reexamination Certificate for:

| | |
|---|---|
| Patent No.: | **6,688,501** |
| Issued: | **Feb. 10, 2004** |
| Appl. No.: | **10/115,188** |
| Filed: | **Apr. 2, 2002** |

Related U.S. Application Data

(63) Continuation of application No. 09/591,576, filed on Jun. 9, 2000, now abandoned.

(51) Int. Cl.
*B65D 47/00* (2006.01)

(52) U.S. Cl. ..... 222/556; 222/563; 222/575

(58) Field of Classification Search ..... None
See application file for complete search history.

(56) References Cited

U.S. PATENT DOCUMENTS

| | | | |
|---|---|---|---|
| 4,638,916 | A | 1/1987 | Beck et al. |
| 4,778,071 | A | 10/1988 | Fillmore |
| 4,795,043 | A | 1/1989 | Odet et al. |
| 6,056,142 | A | 5/2000 | Elliott |
| 6,257,431 | B1 | 7/2001 | Baudin |

*Primary Examiner*—Jeanne M Clark

(57) ABSTRACT

An improved dispensing closure system for dispensing a product from a container includes an elongate or oblong dispensing orifice for dispensing a ribbon of product. The dispensing closure system also includes a spout having a dispensing orifice that is oriented at an angle relative to the closure deck and relative to the flow direction of product from the orifice. The closure system provides for an abrupt "cut-off" of product and thus provides for the dispensing of product in a clean and controlled manner without mess. The closure system also incorporates conical geometries in transition surfaces extending from the container opening to the dispensing orifice. The conical geometries of the transition surfaces provides for a smooth transition of product flow from the container opening to the dispensing orifice, while minimizing the volume defined by the closure system spout and thereby providing increased "suck-back" and an abrupt "cut-off" of product compared to prior art devices.

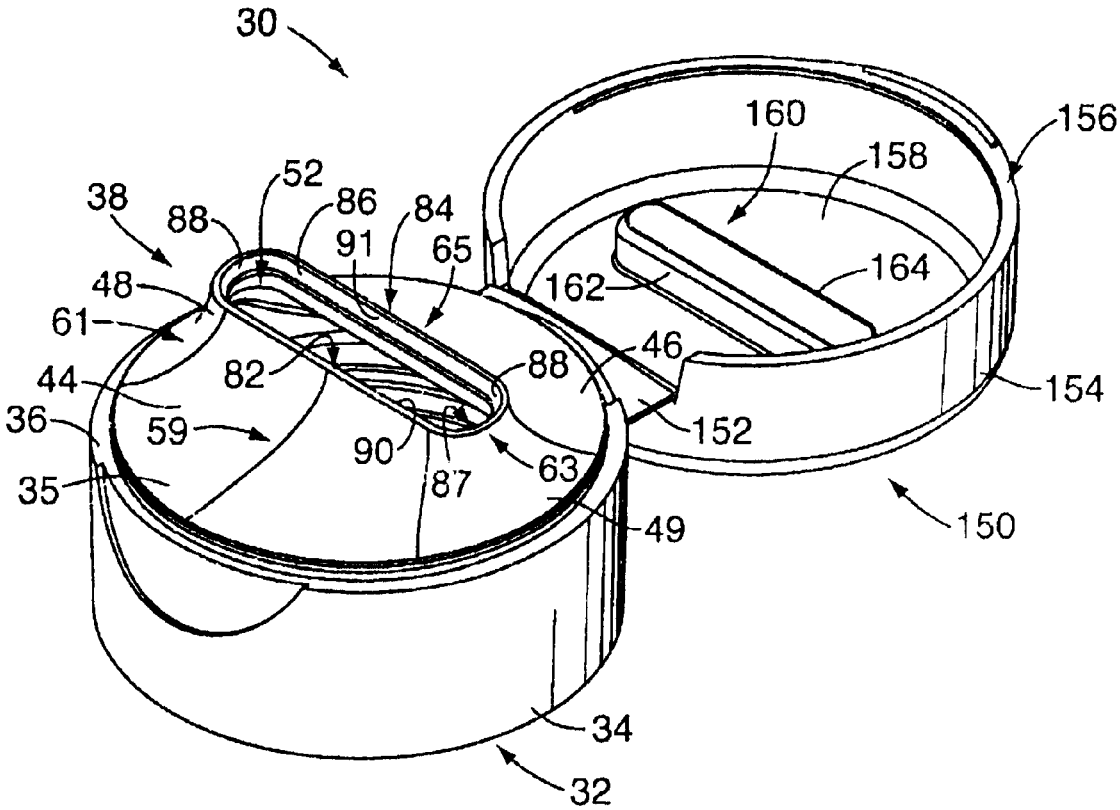

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1 and 2 are cancelled.

* * * * *